United States Patent [19]

Noxon

[11] Patent Number: 5,035,298

[45] Date of Patent: Jul. 30, 1991

[54] WALL ATTACHED SOUND ABSORPTIVE STRUCTURE

[76] Inventor: Arthur M. Noxon, 437 Lawrence St., Eugene, Oreg. 97401

[21] Appl. No.: 502,781

[22] Filed: Apr. 2, 1990

[51] Int. Cl.[5] ..... E04B 1/82

[52] U.S. Cl. ..... 181/295; 52/144

[58] Field of Search ..... 181/30, 287, 295; 52/144, 145

[56] References Cited

U.S. PATENT DOCUMENTS

| | | | |
|---|---|---|---|
| 3,140,564 | 7/1964 | Chapman | 52/144 |
| 4,215,765 | 8/1980 | Harris | 181/287 |
| 4,362,222 | 12/1982 | Hellström | 181/30 |
| 4,548,292 | 10/1985 | Noxon | 181/295 |

*Primary Examiner*—Brian W. Brown

*Attorney, Agent, or Firm*—James D. Givnan, Jr.

[57] ABSTRACT

A sound absorptive structure for installation on room wall structure to reduce low frequency wave energy and enhance room acoustics. A fibrous, sound absorptive member is of curved section and terminates in tapered side edges for inserted engagement with wall mounted strips. The structure may be segmented with partitions between the segments. Alternatively T-shaped divider strips may interconnect adjacent segments. A further modification utilizes a flat base for wall attachment with end portions of the base folded perpendicularly to the base to provide closures for the ends of a sound member. Intersections between segments of a sound absorptive structure may be accomplished by corner mounted box structures or may be mitered for endwise abutment with one another. Openings in the room wall structure increase the volume of the present wall mounted structure.

15 Claims, 2 Drawing Sheets

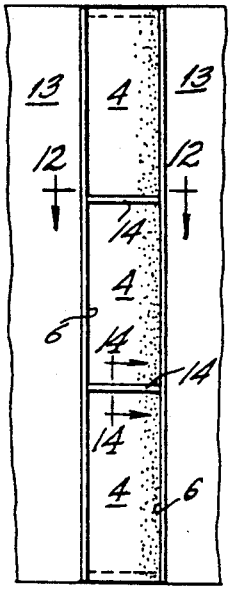
FIG. 11
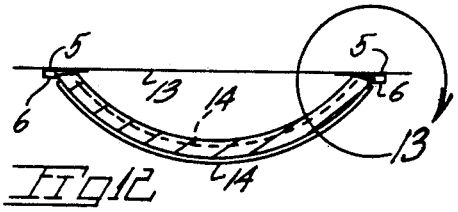
FIG. 12
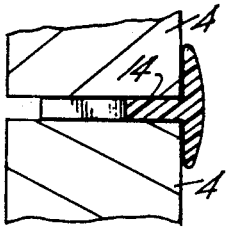
FIG. 14
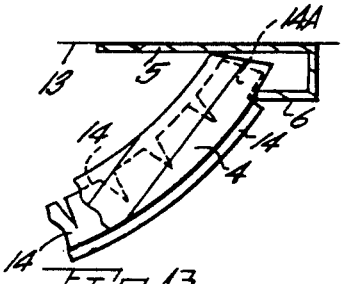
FIG. 13
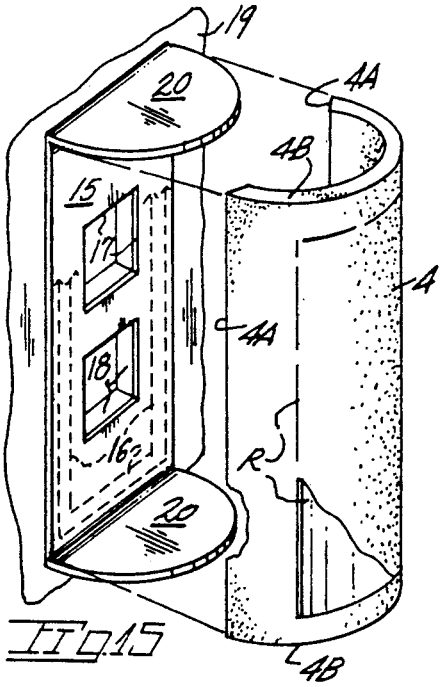
FIG. 15
FIG. 16
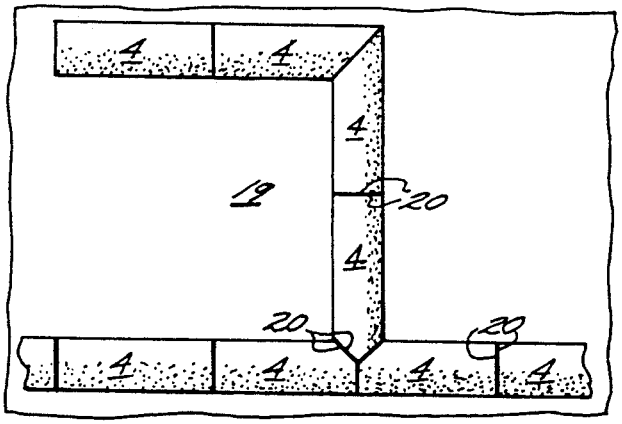
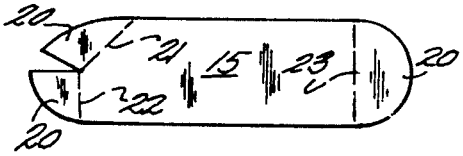
FIG. 17

WALL ATTACHED SOUND ABSORPTIVE STRUCTURE

BACKGROUND OF THE INVENTION

The present invention concerns the installation of sound absorptive structures on a room wall surface or surfaces.

U.S. Pat. No. 4,548,292, issued to the present inventor, discusses acoustical problems encountered in rooms. One solution to the problem is disclosed in the patent and is embodied in a free-standing acoustical device for placement adjacent room wall intersections.

U.S. Pat. No. 4,362,222 discloses a plate or panel of sound absorptive material for diagonal disposition adjacent the corner of a ceiling and room wall. Metal holders extend along the ceiling and wall to support the diagonally disposed plate, mat or panel. The absorptive material is noted as being of mineral wool with the material functioning as membranous absorptives. The patent discloses various modifications for altering the angle of panel inclination as well as the exposed length of a mat. The plate, panel or mat is of planar shape terminating in right angular side edges with no provision made for flexed engagement of the absorptive material with wall attached retainers. U.S. Pat. No. 4,215,765 discloses acoustical wall panels which may be jointed in back-to-back fashion by cooperating strips extending about their perimeters. U.S. Pat. No. 3,140,564 discloses recessed, sound absorptive panels which may be lifted out of a floor recess for diagonal positioning along the lower edge of a temporary room partition. The panels are attached by floor mounted pivots.

SUMMARY OF THE PRESENT INVENTION

The present invention is embodied in the provision of a sound absorptive structure for installation along a wall or ceiling of a room or an intersection thereof.

The present structure includes wall attachable retainers for receiving an edge of a sound absorptive member to provide a chamber within the member which aids the dissipation of low frequency sound wave energy. It has been determined that an effective sound absorptive structure can utilize room wall surfaces to partially define an acoustical chamber. The wall surface or surfaces cooperate with lengths of the sound absorptive members attached to a wall by retention means of the type readily installed to permit a room to be acoustically modified to suit individual preferences. Retention means may include a wall mounted strip having an offset portion for inserted reception of a side edge of the absorptive member. A suitable absorptive member may be formed from a fiberglass tube of the type heretofore used primarily for heat insulative purposes but which lends itself to being lengthwise shaped along chordal lines of severance to provide edges for snug installation on the retention means.

In a modified form of the invention, the retention means is a base with folded ends to close the sound absorptive structure. The base may be secured to a wall with base openings in registration with openings in a room wall to add to the volume of the structure.

Important objectives of the present sound absorptive structure include the provision of an acoustical structure for installation in a room and utilizing lengths of sound absorptive material with side edges for seated engagement into angular wall attached strips; the provision of a sound absorptive structure which utilizes fiberglass material preferably formed from a length of fiberglass tubing to provide a low cost absorptive structure for convenient installation in a room by the end user; the provision of a sound absorptive structure utilizing a fiberglass absorptive member of curved section which may be of different curvature determined by the degree of flexure applied to best accommodate the acoustic objectives at hand; the provision of a sound absorptive structure of segmented construction to permit sizing of the structure to the room area with segments of the structure joined by partitions or T-shaped strips; the provision of a sound absorptive structure with a planar base having openings therein for registration with openings in a room wall or ceiling structure to increase the effective volume of the sound absorptive structure for greater efficiency.

BRIEF DESCRIPTION OF THE DRAWINGS

In the accompanying drawings:

FIG. 11 is an elevational view of a modified sound absorptive structure in upright placement on a room wall fragment;

FIG. 12 is a horizontal sectional view taken along line 12—12 of FIG. 11;

FIG. 13 is an enlarged fragmentary view of the structure encircled at 13 in FIG. 12;

FIG. 14 is a vertical sectional view taken along line 14—14 of FIG. 11;

FIG. 15 is a perspective exploded view of a further modified form of a sound absorptive structure;

FIG. 16 is a plan view of a ceiling showing a typical disposition of the further modified sound absorptive structure of FIG. 15; and FIG. 17 is a plan view of modified retention means having a base with foldable portions for engagement with a sound absorptive member.

DETAILED DESCRIPTION OF THE PREFERRED EMBODIMENTS

Figure 1:
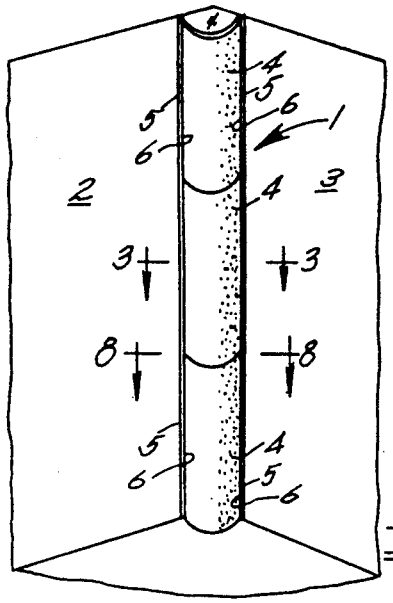
FIG. 1 is a perspective view of a room corner with an upright sound absorptive structure therein.

With continuing attention to the drawings wherein applied reference numerals indicate parts similarly hereinafter identified, the reference numeral 1 indicates generally a wall attached sound absorptive structure disposed in an upright manner at the intersection of room walls at 2 and 3.

Sound absorptive structure 1 is shown as being of segmented construction with elongate bodies or members of sound absorptive material indicated at 4. One suitable material is fiberglass of the medium density which is marketed in cylindrical form which facilitates shaping as later described.

Figure 6:
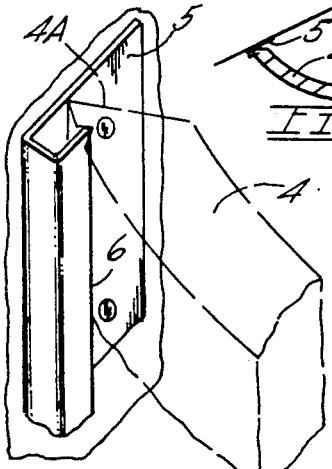
FIG. 6 is a perspective view of wall mounted retention means in engagement with a fragment of sound absorptive material shown in phantom lines.
Figure 3A:
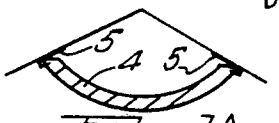
FIG. 3A is a view similar to FIG. 3 but showing the present sound absorptive structure in place on intersecting room walls defining an angle other than 90 degrees.

Retention means for the material includes strips at 5 which are J shape in section and provided for attachment to wall or wall and ceiling structure in a parallel manner. The strips 5, best shown in FIG. 6, have an offset or hooked edge at 6 which serves to retain the sound absorptive body 4 in place. Side edges 4A of the body 4 are of a tapered configuration in section for cooperation with the hook shaped retention strips 5.

Figure 2:
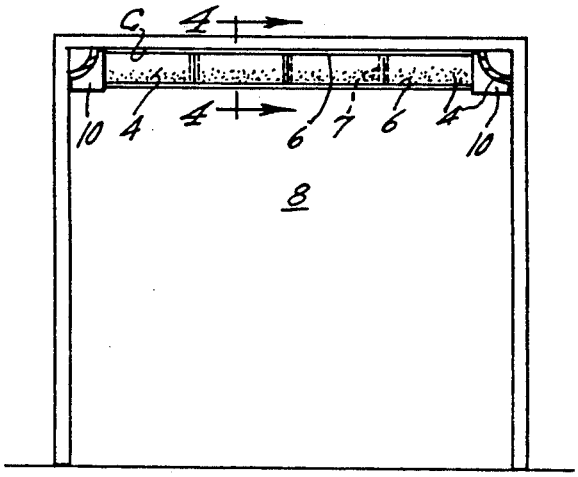
FIG. 2 is a vertical sectional view of a room with a horizontally disposed sound absorptive structure in place along a room wall and ceiling intersection.
Figure 3:
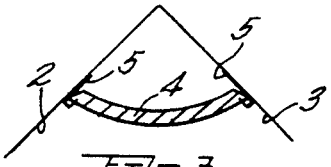
FIG. 3 is a horizontal sectional view taken downwardly along line 3—3 of FIG. 1.

In FIG. 2 the sound absorptive bodies 4 are horizontally disposed along a wall and ceiling intersection with the retention strips 5 extending one each along the wall and the ceiling. Both the horizontally disposed sound absorptive structure shown in FIG. 2, as well as the vertically disposed structure in FIG. 1, are as earlier noted, of segmented construction and may include partitions as at 7 serving as closure means between adjacent segments. Accordingly, a chamber is formed by each sound absorptive body 4, partitions 7, and room wall surfaces 2 and 3 or a wall 8 and a ceiling surface at C in the horizontal version of FIG. 2. Each partition 7 may be grooved at 7A to receive the ends 9A of a cover 9 on each sound absorptive member 4. A sealant at 11 prevents air passage.

Figure 4:
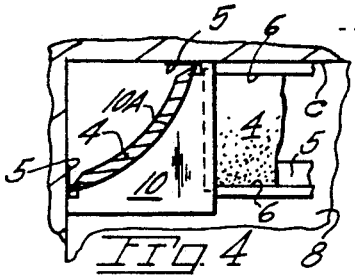
FIG. 4 is a vertical sectional view taken along line 4—4 of FIG. 2.

In certain installations it may be desirable to locate sound absorptive structures along two or more contiguous ceiling and wall intersections, and for this purpose a box structure 10 may be located at the room corners, and best shown in FIGS. 2 and 4, to receive the ends of adjacent members 4. The box structure is formed with a curved opening 10A to receive curved member 4 as best shown in FIG. 4. The fit between the sound absorptive members and the box opening is snug to avoid any gaps for acoustical purposes. Sound absorptive members 4 which intersect one another may be mitered or otherwise shaped to provide continuous appearance.

Figure 5:
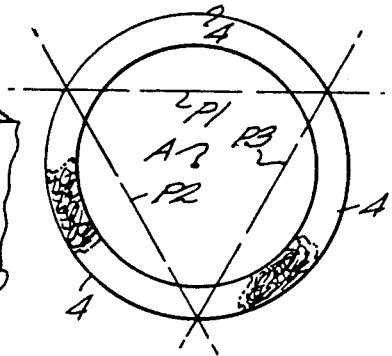
FIG. 5 is an end view of a cylinder with lines of severance shown in phantom lines for shaping a sound absorptive member.
Figure 7:
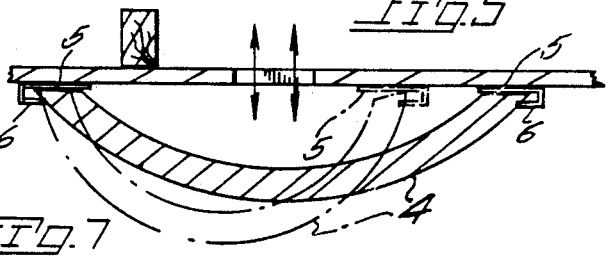
FIG. 7 is a horizontal sectional view of a room wall with a sound absorptive member attached thereto by wall mounted retention means.
Figure 8:
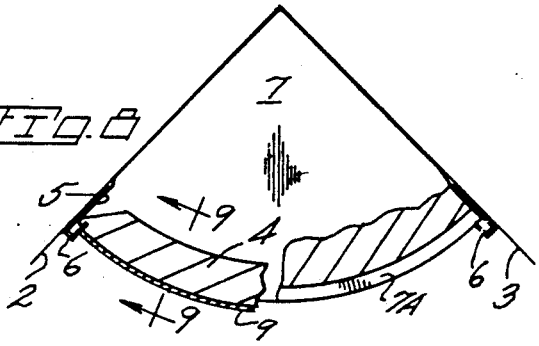
FIG. 8 is a horizontal sectional view taken downwardly along line 8—8 of FIG. 1.
Figure 10:
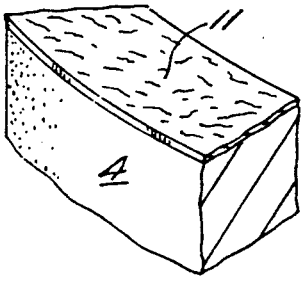
FIG. 10 is a fragmentary perspective view of a sound absorptive member with a surface coating of adhesive for airtight securement to a partition or adjacent like body.
Figure 9:
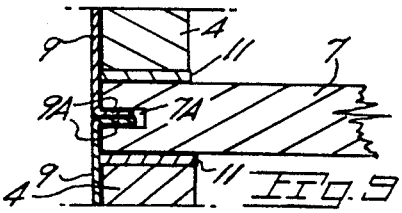
FIG. 9 is a vertical sectional view taken along line 9—9 of FIG. 8.

With attention again to the sound absorptive material deemed suitable for present purposes, the same is commonly termed fiberglass manufactured and sold in cylindrical or tubular form as shown in FIG. 5 for heat insulation purposes. The side edge configuration at 4A is provided by the lengthwise severing of the acoustical material along chordal planes indicated at P1, P2, and P3 resulting in symmetrical sound absorptive members having an arc of 120 degrees. As the fiberglass material is fibrous and semi-rigid, it may be flexed to permit shaping about different radiuses. A suitable fiberglass material is of medium density or about three pounds per cubic foot. When reshaped or flexed to a somewhat lesser radius such flexing provides for inherent biased engagement with wall mounted strips 5. Various other shapes and sizes of sound absorptive material may be utilized, as for example, one formed from a single plane of severance containing the axis A of the tubular material. As shown in FIG. 7, the spacing of a pair of strips 5 to one another may determine the sectional curvature of the sound absorptive member 4.

The present sound absorptive structures may be installed on a single wall structure 13 of a room per FIG. 11 wherein a T-shaped strip at 14 provides a joint between wall attached absorptive members 4. The strip 14 includes trimmed ends as at 14A for inserted engagement with wall mounted retention strips 5. Solid partitions 7 may alternatively be installed between absorptive members 4 to provide a chamber within each of said members. Said partitions would have a curved edge on a radius substantially corresponding to the radius of the wall attached member 4.

A modified version of the sound absorptive structure is shown in FIGS. 15–17 wherein retention means are embodied in a planar base 15 for wall attachment as by double sided adhesive tape strips 16 or other suitable means. The base may define openings at 17 which correspond to openings 18 in a room wall structure 19 to increase the effective volume of the device to enhance low frequency sound absorptive characteristics and efficiency of the present structure. A suitable base 15 may include integral closure means as end portions 20 of the base positioned perpendicularly to the base proper. The application of an adhesive sealant along the side edges 4A and end edges 4B provide a continuous seal with the base and end portions 20.

In application of the present sound absorptive structure to rooms where the listener is located ten feet or so from a room wall, it is desirable to include a reflector R in place on sound absorptive member 4 with the reflector of the sheet type shown and described in U.S. Pat. No. 4,548,292. In larger rooms, such as gymnasiums, the reflector is preferably dispensed with.

As shown in FIG. 17, base 15 may be shaped to provide end portions 20 which may be swung about fold lines at 21, 22 and 23 to provide closure means for intersecting sound absorptive structures as shown in FIG. 16.

While openings in room wall structure are shown in conjunction with the modified form of retention means i.e., base 15, it will be understood that an opening in a room wall may be provided rearwardly of any of the other forms of sound absorptive structures presently disclosed for the purpose supplementing the effective volume of said structures.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A sound absorptive structure for installation on a room wall structure, said sound absorptive structure comprising, an elongate body of sound absorptive material of curvlinear section and having side edges and terminating at opposite ends, retention means for attachment to this room wall structure and including surfaces to receive and retain said side edges of said body proximate the room wall structure, and closure means in place on the opposite ends of said elongate body.

2. The structure claimed in claim 1 wherein said elongate body is of a flexible fibrous material.

3. The structure claimed in claim 1 wherein said elongate body is of random fiberglass strands and of curved transverse section.

4. The structure claimed in claim 1 wherein said elongate body is of arcuate transverse section, the side edges of said elongate body in a chordal plane.

5. The structure claimed in claim 1 wherein said retention means are strips each having an offset portion for engagement with said elongate body of sound absorptive material.

6. The structure claimed in claim 1 wherein said retention means is a backing plate substantially coextensive in length with said elongate body.

7. The structure claimed in claim 6 wherein said closure means are end walls integral with said backing plate.

8. The structure claimed in claim 1 wherein said elongate body of sound absorptive material is comprised of segments.

9. The structure claimed in claim 8 wherein said closure means are partitions located between said segments and in abutment therewith.

10. The structure claimed in claim 9 wherein each of said partitions define a groove, a cover on said elongate body having margins received in a partition groove.

11. The structure claimed in claim 8 additionally including divider strips disposed between said segments.

12. The structure claimed in claim 1 wherein said retention means includes a base to which said side edges of said elongate body are mounted.

13. The structure claimed in claim 12 wherein said elongate body is of a fibrous nature with said base defining openings for registration with openings in the room wall structure.

14. The structure claimed in claim 12 wherein said elongate body is substantially arcuate in section, said side edges being in a chordal plane.

15. The structure claimed in claim 12 wherein said closure means are integral with the base and are positionable along fold lines.

* * * * *